US007987530B2

(12) United States Patent
Chiu et al.

(10) Patent No.: US 7,987,530 B2
(45) Date of Patent: Aug. 2, 2011

(54) FLUSHING SITZ BATH BASIN

(76) Inventors: Kwok Wai Chiu, Plano, TX (US); Ralph Gardner, Dallas, TX (US); Timothy Chiu, Plano, TX (US)

( * ) Notice: Subject to any disclaimer, the term of this patent is extended or adjusted under 35 U.S.C. 154(b) by 402 days.

(21) Appl. No.: 12/322,633

(22) Filed: Feb. 6, 2009

(65) Prior Publication Data

US 2010/0199419 A1 Aug. 12, 2010

(51) Int. Cl.
*A47K 3/022* (2006.01)

(52) U.S. Cl. ..... 4/445; 4/420.3

(58) Field of Classification Search ..... 4/420.3, 4/445–446

See application file for complete search history.

(56) References Cited

U.S. PATENT DOCUMENTS

| | | | | | |
|---|---|---|---|---|---|
| 2,947,994 | A | * | 8/1960 | Saulson et al. | 4/445 |
| 3,034,137 | A | * | 5/1962 | Glou | 4/445 |
| 3,039,117 | A | * | 6/1962 | Hoskins | 4/444 |
| 3,072,918 | A | * | 1/1963 | McCall et al. | 4/445 |
| 3,916,453 | A | * | 11/1975 | Dominguez-Armada | 4/445 |
| 4,207,628 | A | * | 6/1980 | Ibel | 4/445 |
| 5,361,427 | A | * | 11/1994 | Wilk | 4/420.3 |
| 5,734,997 | A | * | 4/1998 | Raff | 4/420.2 |

* cited by examiner

*Primary Examiner* — Charles Phillips

(57) ABSTRACT

A sitz bath helps patients suffering from hemorrhoids and other conditions to void their bowels. A flushing sitz bath utilizes an attached liquid filling tube, integrated water distribution channel and valve, a swing check valve, and a content-emptying flapper valve. This device helps to increase the efficiency of filling the sitz bath basin with the preferred liquid, as well as increasing the ease and cleanliness of the subsequent emptying of the basin contents by minimizing bodily strain and mess.

4 Claims, 10 Drawing Sheets

FLUSHING SITZ BATH BASIN

BACKGROUND

1. Technical Field

The present invention relates to an improved sitz bath basin being adapted for the more efficient filling of liquids and emptying of contents for the treatment and healing of hemorrhoids and other conditions. More specifically, the present invention includes a manually controlled water conduction system allowing for water or other liquid to fill the basin from a specified source, a manually operated flapper valve allowing for more efficient emptying of sitz bath contents, and a swing check valve system allowing the water from a toilet flush to clean out the contents of the basin.

2. Background of the Invention

The sitz bath basin is a common apparatus used by people who suffer from hemorrhoids and other conditions, and whom often have pain and difficulty in voiding their bowels. While a high fiber diet and plenty of water help, they are often not enough. One possible solution is to sit in a sitz bath filled with warm water, wherein the water will lubricate the fecal material and make it easier to have a bowel movement.

The most common form of the sitz bath consists of a simple basin capable of fitting on the rim of a toilet bowl. Current methods require liquid to be manually poured into the sitz bath basin. Likewise, the contents of the basin must be subsequently emptied by physically lifting the entire sitz bath basin and disposing of the contents in an appropriate fashion, often by pouring the contents into the toilet. This can not only require significant bodily strain, as the filled basin can be heavy, but it can also result in an unsanitary mess due to accidental spillage of the basin contents. As a result, current methods of filling and emptying sitz baths are time-consuming, physically strenuous, and unsanitary.

There thus exists a great need to provide a sitz bath basin capable of clean and efficient filling and emptying of its contents.

SUMMARY OF THE INVENTION

Objects and advantages of the invention are set forth below.

An object of the present invention is to provide a sitz bath basin offering enhanced ease in filling the basin with the preferred liquid contents such as, but not limited to, water.

Another object of the present invention is to provide a sitz bath basin offering enhanced ease and cleanliness in emptying the contents of the basin.

Yet another object of the present invention is to provide a sitz bath basin offering enhanced efficiency in inducing bowel movements.

According to the present invention, the device consists of a basin with a rim which allows it to sit on a toilet. The basin has a water channel lined around the outside of the rim that allows the basin to be filled directly from the warm water faucet in the bathroom through the connection of a fitted hose to a user-controlled valve located on the flushing sitz bath.

The basin has a drain at its bottom that is normally held closed by a flapper valve array which is held in place by springs. Once the user is finished having a bowel movement, he or she pulls on the cable that is attached to the flapper valve, opening it and allowing the contents of the basin to directly empty into the toilet.

Flushing the toilet while the flapper valve cable is being pulled up causes the water from the toilet flush to be captured by a scoop attached the front of the basin, which then enters through a swing check valve into the basin, rinsing it clean.

The user then releases the cable attached to the flapper valve to close the hole in the basin. The basin can then be refilled if desired.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

While the invention is described below with respect to a preferred embodiment, other embodiments are possible. The concepts disclosed herein apply equally to other devices for increasing the efficiency and ease of filling and emptying the contents of a sitz bath basin, provided that they follow the spirit of the teachings disclosed herein.

Whereas many prior sitz baths are limited to requiring liquids to be poured into the basin manually or by physically moving the bath to the source of the liquid in order to be filled, the present invention enables one to connect a fitted tube directly to a bathroom faucet while keeping the bath stationary on the toilet rim, allowing for quick and efficient filling. Likewise, many prior sitz baths required the entire bath to be picked up and turned in order to empty the contents. The present invention enables a user to quickly and cleanly empty the basin by opening a flapper valve and allowing the contents to drain out. Such efficient filling and emptying of the sitz bath is made possible with the present flushing sitz bath device as disclosed herein.

Figure 1:
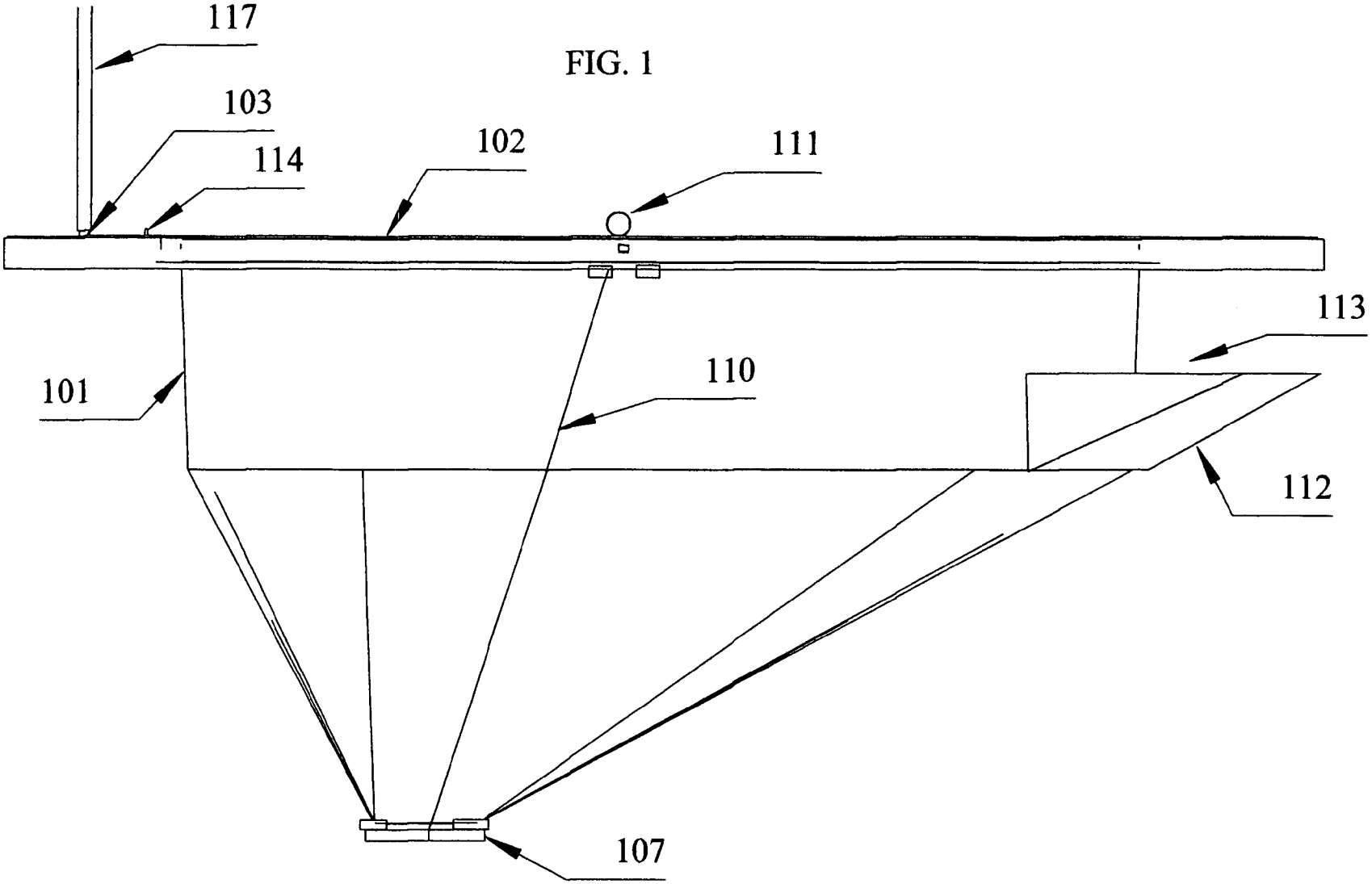
FIG. 1 shows a side view of the sitz bath in accordance with the present invention.
Figure 2:
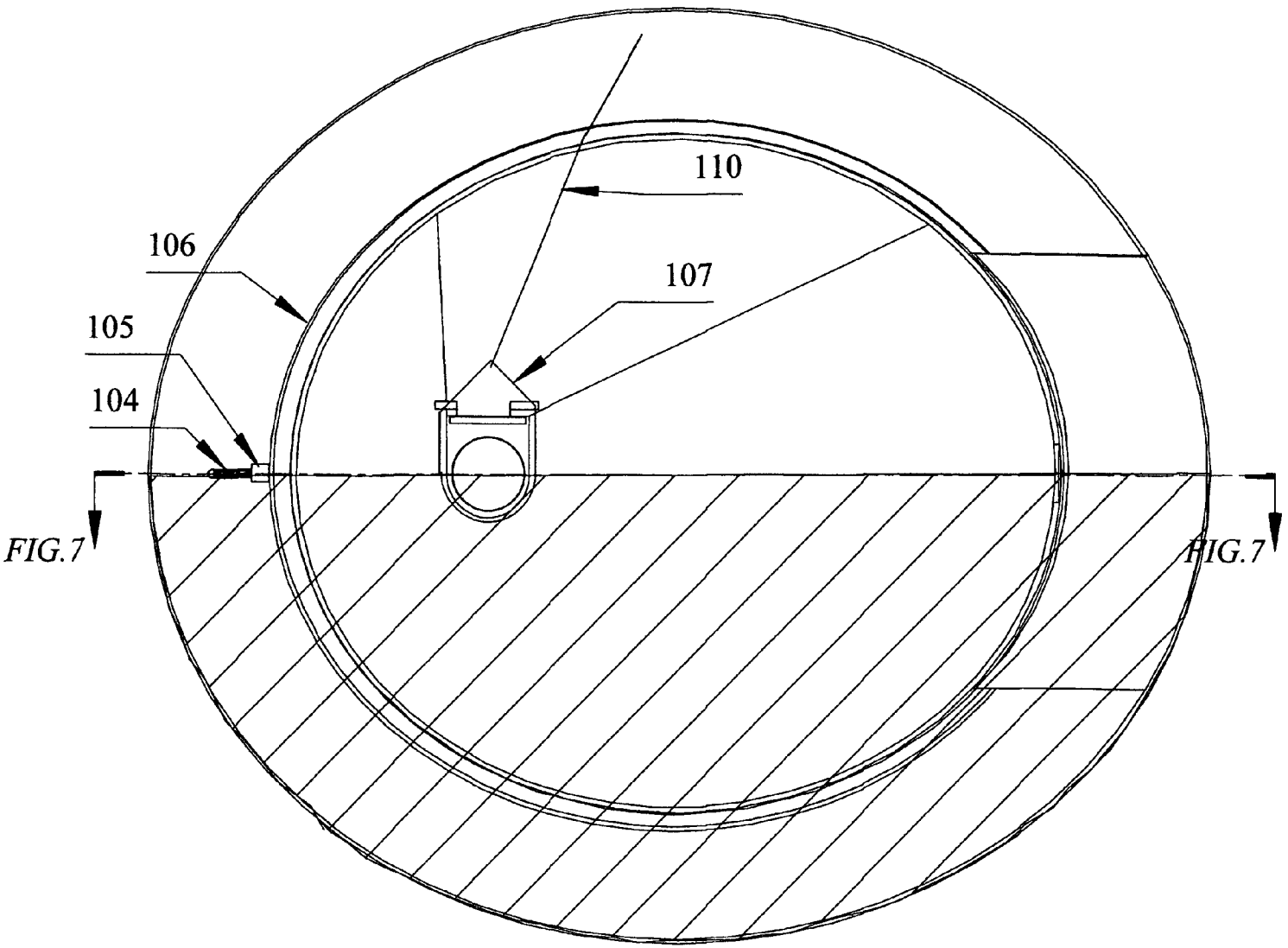
FIG. 2 shows a bottom view of the sitz bath in accordance with the present invention.
Figure 3:
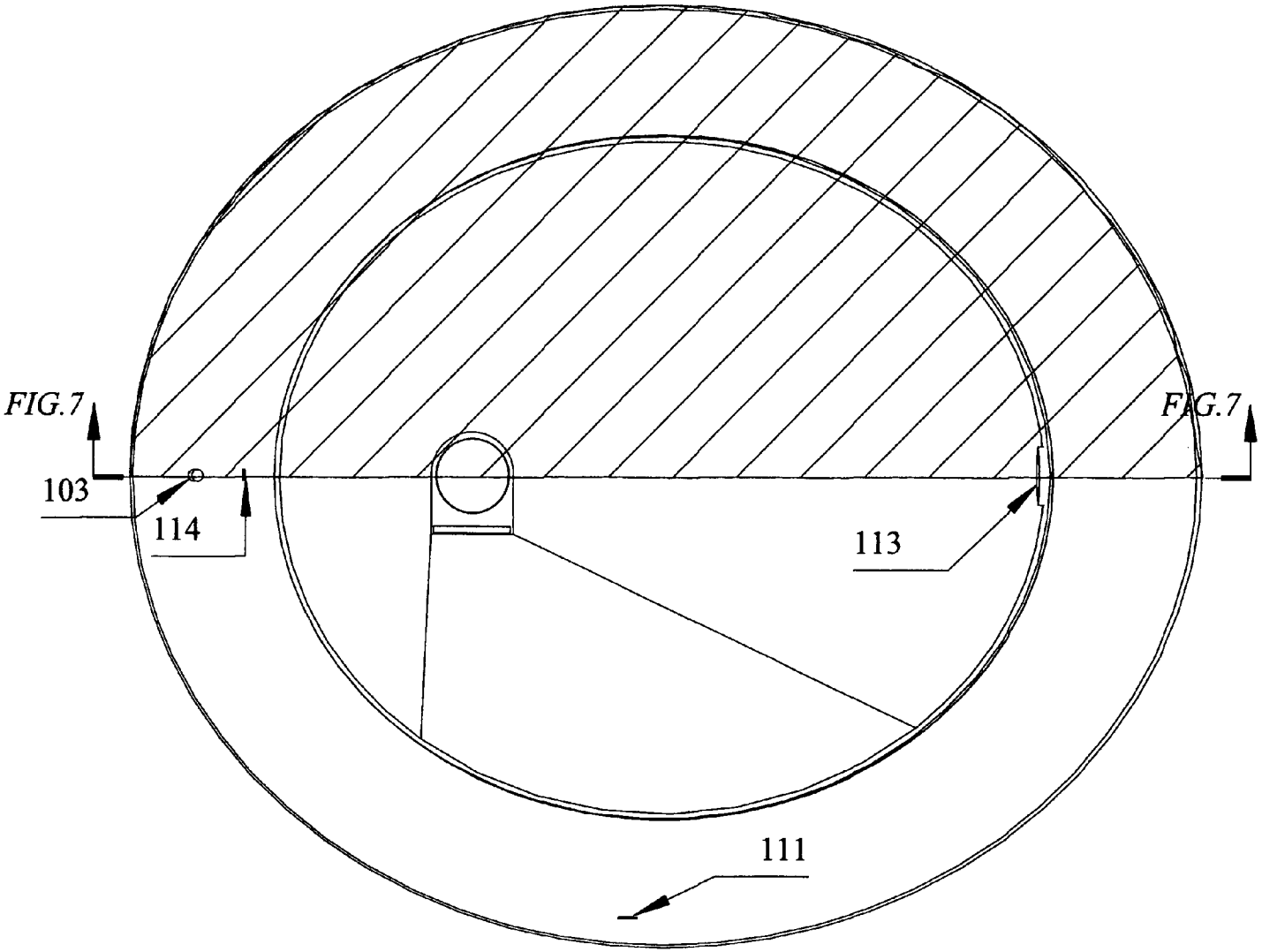
FIG. 3 shows a top view of the sitz bath in accordance with the present invention.
Figure 5:
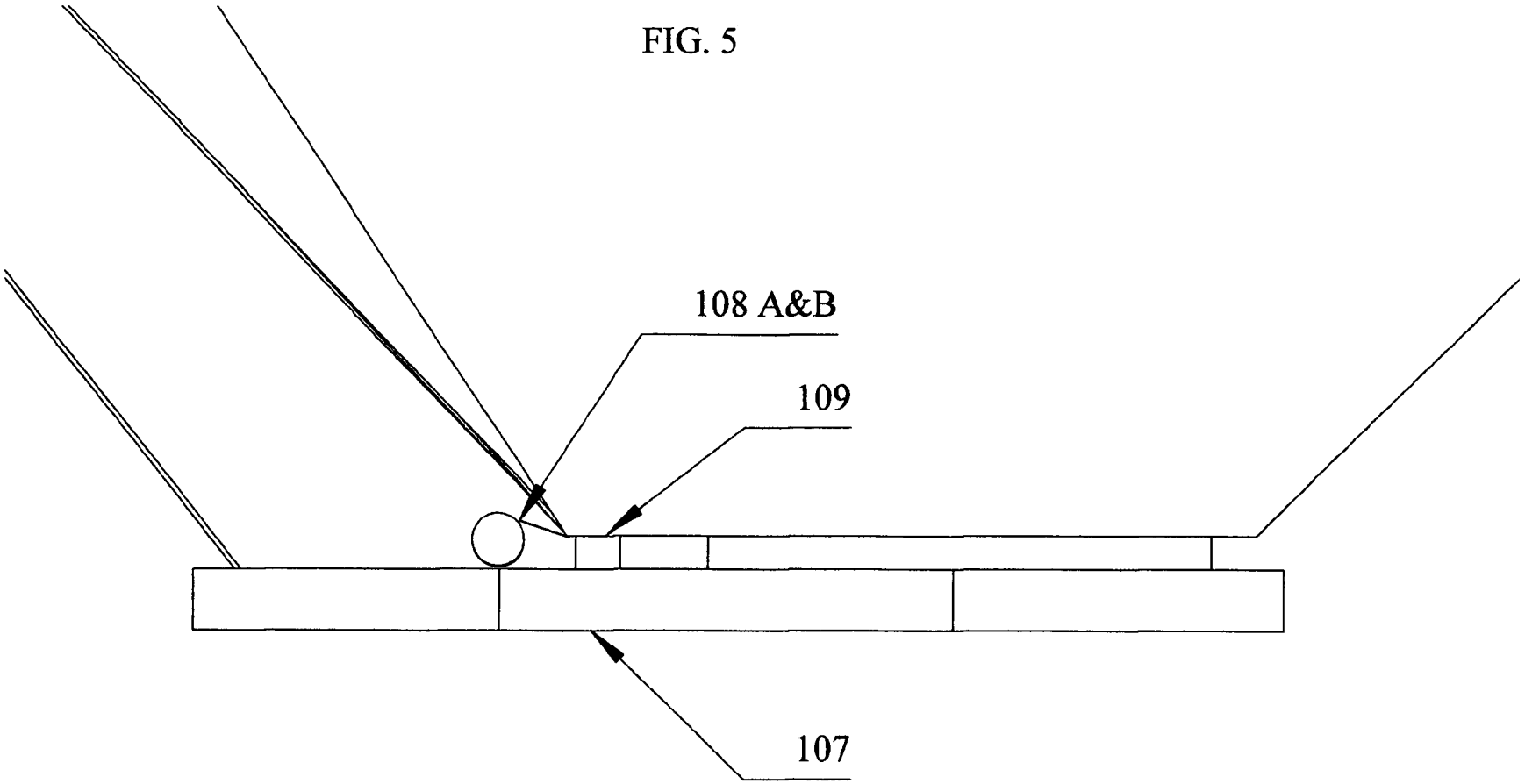
FIG. 5 shows a side view of the flapper valve system in accordance with the present invention.
Figure 6:
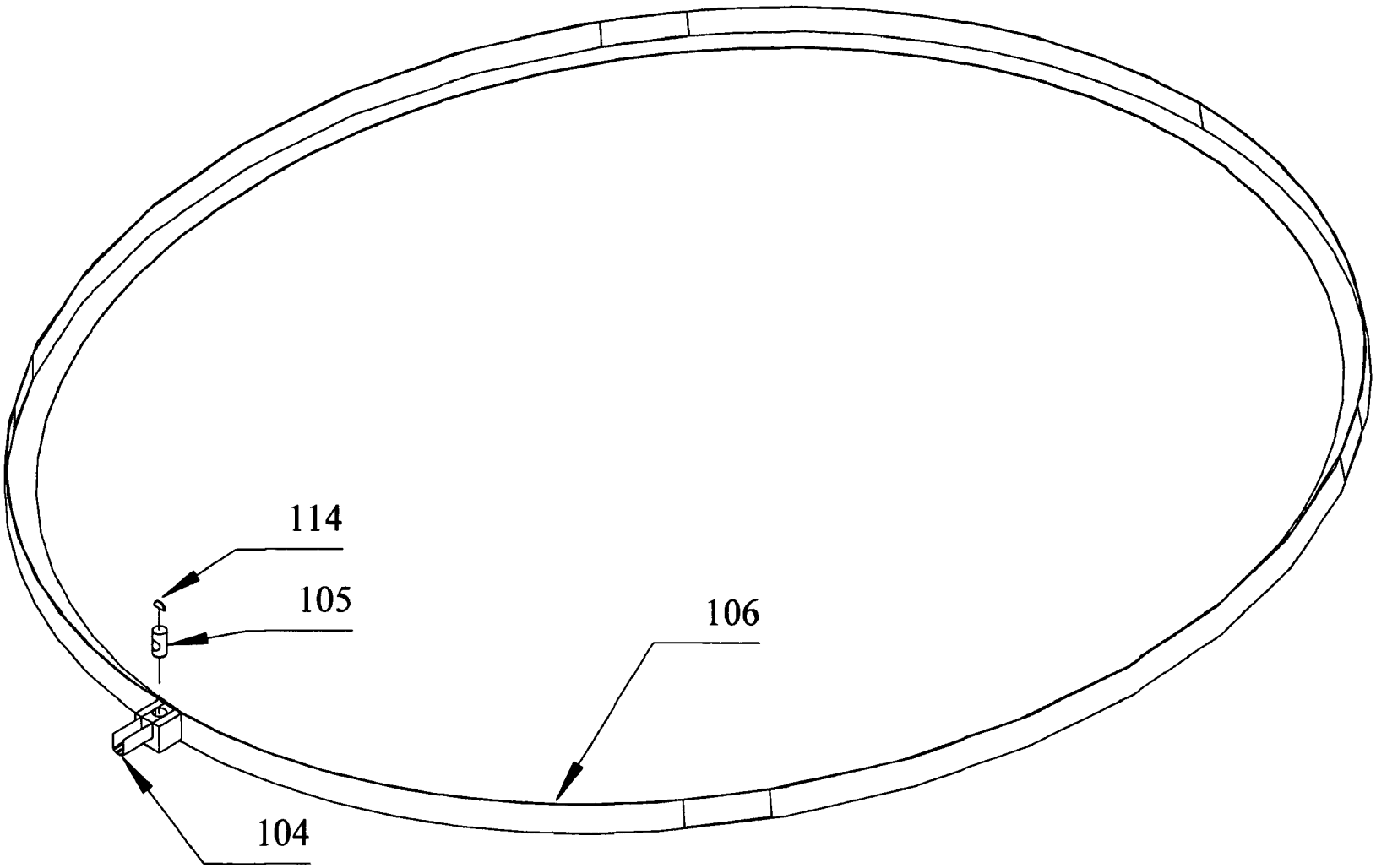
FIG. 6 shows a ¾ profile exploded view of the water channel that is fitted around the basin, in accordance with the present invention.
Figure 7:
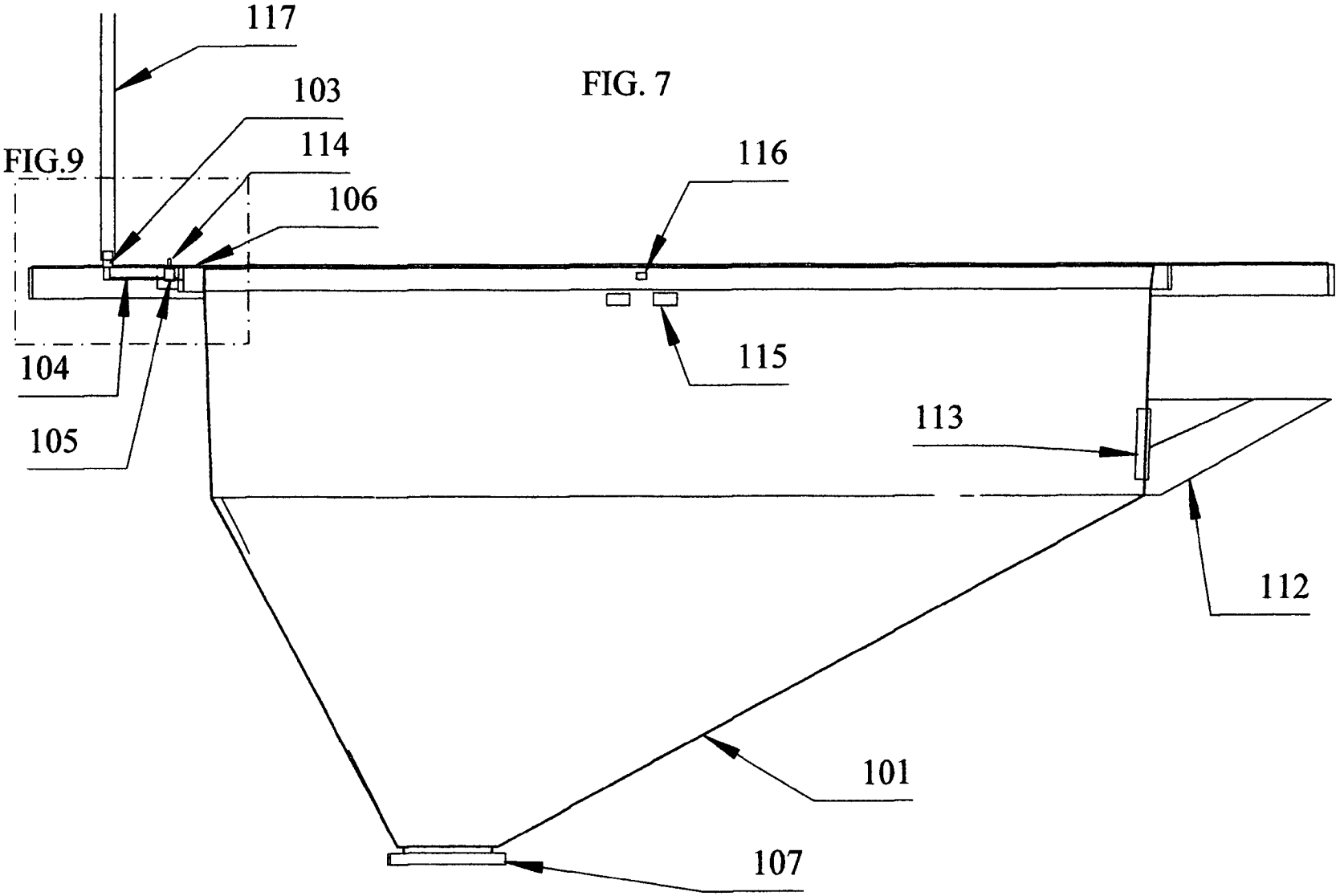
FIG. 7 shows a sectional view of the sitz bath in accordance with the present invention.
Figure 8:
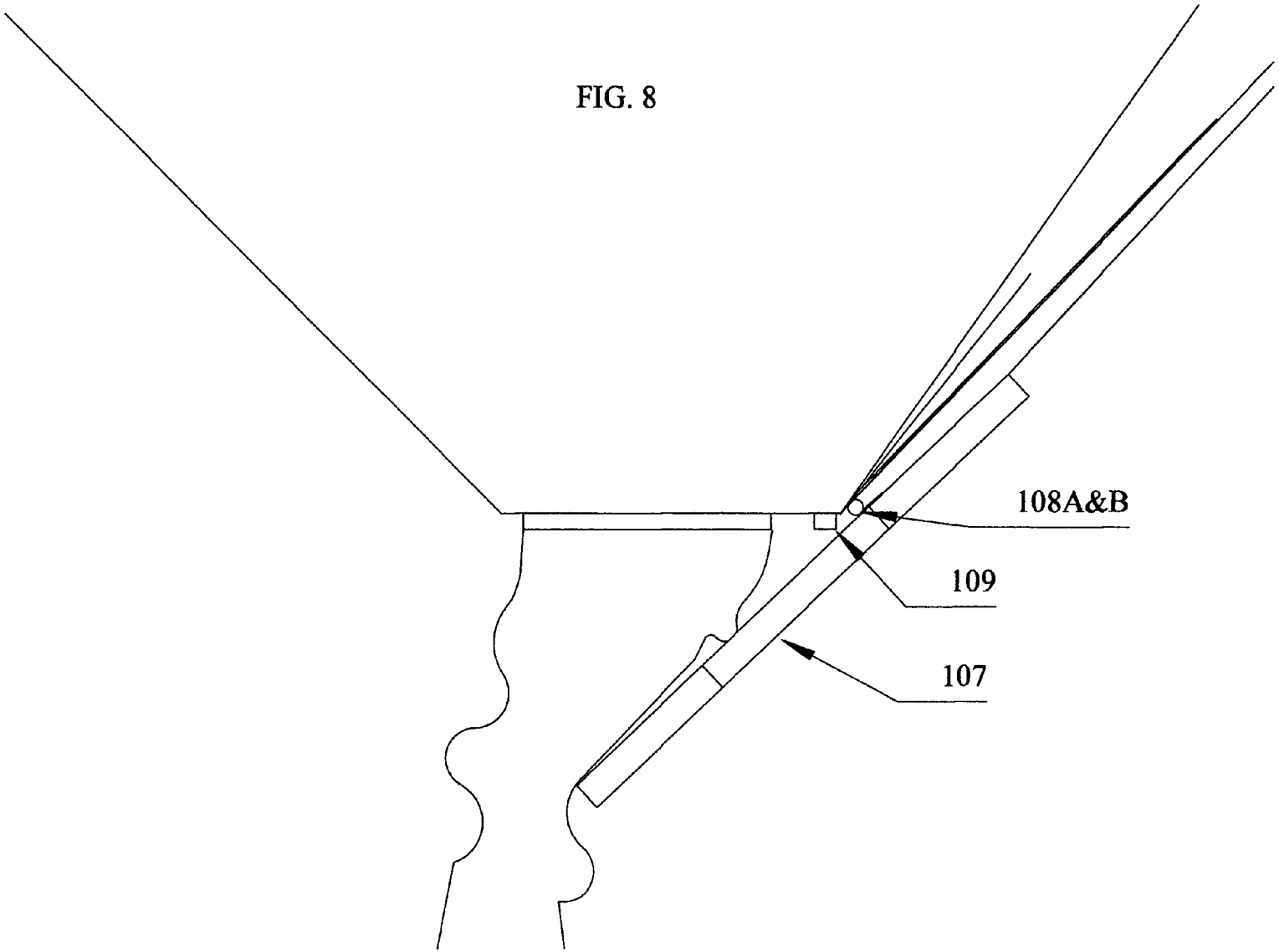
FIG. 8 shows a side view of the flapper valve opening to allow contents to exit from the bottom of the basin.
Figure 9:
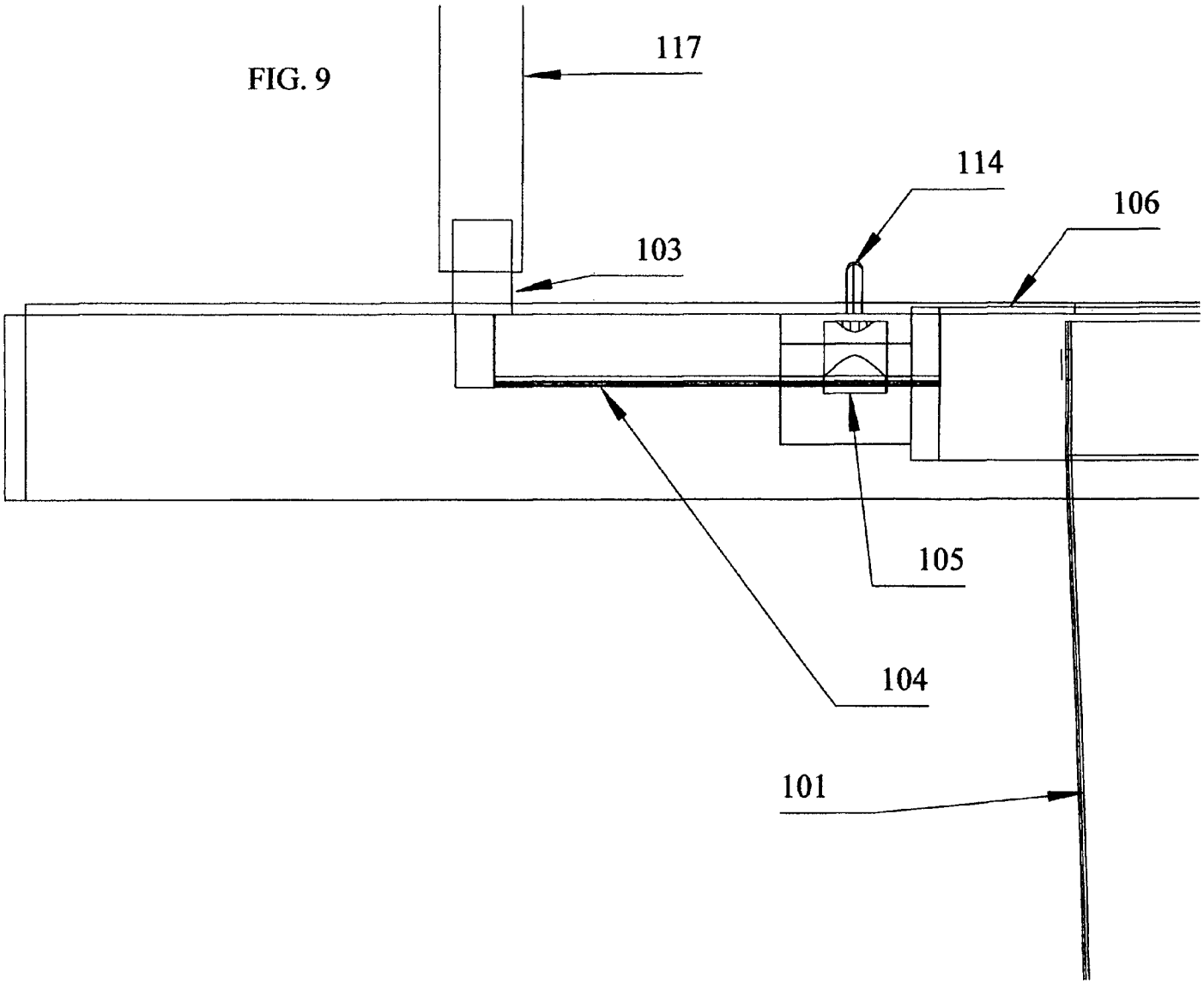
FIG. 9 shows a sectional view of the water entry channel and valve.
Figure 10:
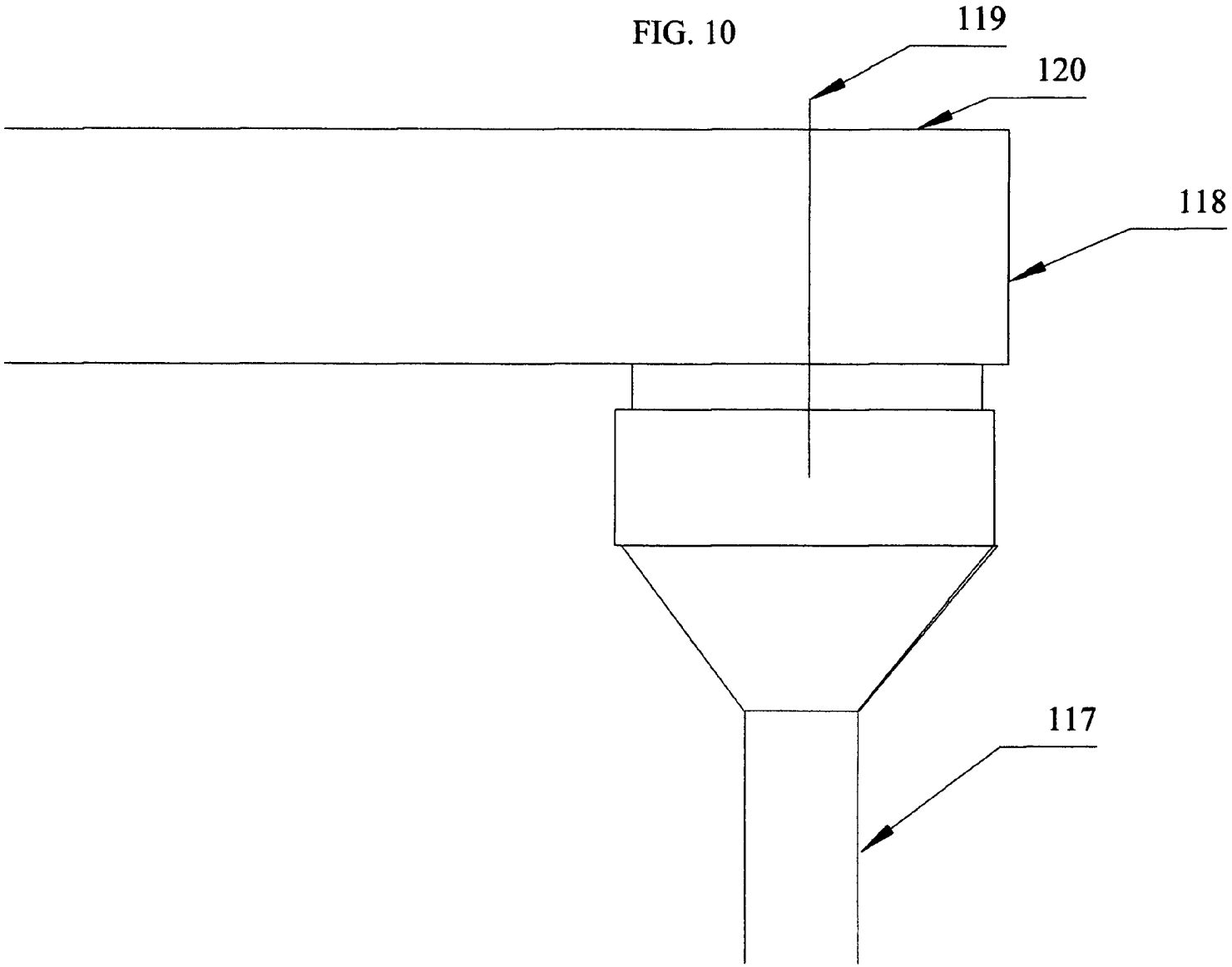
FIG. 10 shows a side view of the water tube connection to a faucet.

Referring to FIG. 1, a side view of the flushing sitz bath is shown. The sitz bath consists of a basin 101, with a rim 102 that holds the basin in the bowl of a toilet so that the user can sit on it. Referring to FIG. 10, the basin can be filled by the passage of water through a rubber water tube 117 that is attached to the water faucet 120 in a bathroom lavatory. At one end of the rubber water tube 117 is a faucet connection port 118 which is placed under the faucet opening, and held in place over the faucet by a rubber strap 119. Referring to FIG. 9, the other end of the rubber water tube 117 is fitted over a tube stem 103. This tube stem 103 leads to a water entry passage 104 controlled by the valve stem 105, which can be turned on or off through the manual manipulation of the plastic handle 114. As shown in FIG. 7, the input passage 104 leads directly to the water channel 106 located on the outside of the basin. When the bathroom faucet is turned on, the water rushes through the water channel 106 and out into the basin 101 through the water channel holes 116 located on the water channel. Any excess water will flow out through the overflow holes 115 into the toilet bowl. Referring to FIG. 1 and FIG. 5, a cord 110 with a ring 111 attached at the end is connected to the flapper valve 107, which is kept in a closed position through the aid of a hinge 109 and flapper return springs 108A and 108B. As seen in FIG. 8, pulling up on the cord opens the flapper valve, emptying the contents of the basin out into the toilet bowl. When a user is finished passing a bowel movement, the user may rinse the sitz bath basin by flushing the toilet. Referring to FIG. 7, water from the flushing of the toilet is captured by the wash water scoop 112 and allowed into the empty basin through a check valve 113, rinsing out the basin. By pulling on the aforementioned cord, the contents of the basin can be emptied.

Figure 4:
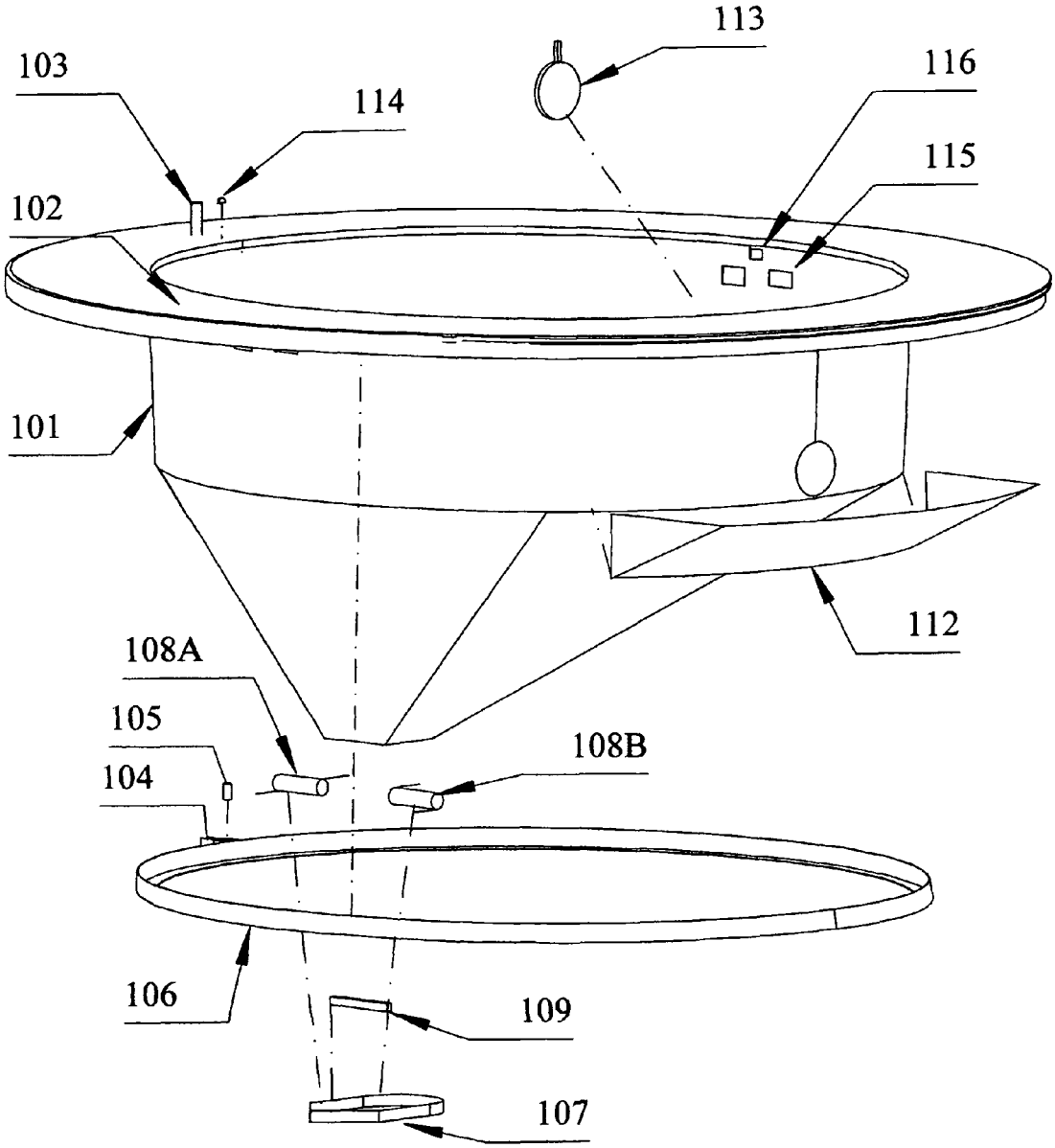
FIG. 4 shows a ¾ profile exploded view of the flushing sitz bath, in accordance with the present invention.

Referring to FIG. 4, the bath is constructed from 6 principle parts. The basin 101 and rim 102 are molded as a single part. The water channel 104 and valve casing are molded as another principle part which is affixed around the basin. The wash water scoop 112 fitting is yet another principle part attached to the outside of the basin. The swing check valve 113 is hinged in place over the wash water opening in the side of the basin and is also a principle part of the device. Another principle part is the flapper valve 107, which is hinged in place covering the drain at the bottom of the basin, which is held closed by the springs 108A & 108B.

The flushing sitz bath may be made of any material suitable for use within a hygienically sterile environment. In one embodiment of the present invention, the flushing sitz bath is made from medical grade plastic, however it is understood that it may be manufactured from any suitable material.

Although warm water is the most commonly used liquid for filling the sitz bath basin, it is understood that any appropriate liquid may also be used.

While the invention has been particularly shown and described with reference to a preferred embodiment, it will be understood by those knowledgeable in the field that various changes in form and detail may be made therein without departing from the spirit and scope of the invention.

We claim:

1. A flushing sitz bath device comprising:

a basin for holding liquid, said basin having a rim at a top thereof for seating engagement on an upper surface of a toilet bowl rim so as to suspend said basin in the toilet bowl, said basin including a wash water scoop positioned on an outer surface thereof, below said basin rim and said scoop being positioned so as to capture a portion of the water normally used to flush the toilet bowl and direct said water into said basin, through an opening in said basin, when said basin rim is seated on said toilet bowl rim, said basin having a drain opening therein to allow liquid to flow out of said basin and a sitz bath water inlet.

2. The sitz bath of claim 1 wherein said sitz bath water inlet comprises; a fitted water tube and water channel array for allowing efficient filling of said basin.

3. The sitz bath of claim 1 wherein said drain opening is controlled by a flapper valve for efficient and clean disposal of basin contents.

4. The sitz bath of claim 1 wherein a valve controls the inlet of water from said scoop.

* * * * *